US008143774B2

(12) United States Patent
Hu

(10) Patent No.: US 8,143,774 B2
(45) Date of Patent: Mar. 27, 2012

(54) CARBON BASED FIELD EMISSION CATHODE AND METHOD OF MANUFACTURING THE SAME

(75) Inventor: Qiu-Hong Hu, Göteborg (SE)

(73) Assignee: Lightlab Sweden AB, Saltsjobaden (SE)

( * ) Notice: Subject to any disclaimer, the term of this patent is extended or adjusted under 35 U.S.C. 154(b) by 782 days.

(21) Appl. No.: 11/988,504

(22) PCT Filed: Jul. 6, 2006

(86) PCT No.: PCT/EP2006/006591

§ 371 (c)(1),
(2), (4) Date: Dec. 4, 2008

(87) PCT Pub. No.: WO2007/006479

PCT Pub. Date: Jan. 18, 2007

(65) Prior Publication Data

US 2009/0167140 A1 Jul. 2, 2009

(30) Foreign Application Priority Data

Jul. 14, 2005 (EP) ..... 05106440

(51) Int. Cl.
*H01J 1/00* (2006.01)

(52) U.S. Cl. ..... 313/311; 445/51

(58) Field of Classification Search ..... 313/311; 445/51

See application file for complete search history.

(56) References Cited

U.S. PATENT DOCUMENTS

| | | | | |
|---|---|---|---|---|
| 4,143,292 | A * | 3/1979 | Hosoki et al. | 313/336 |
| 4,250,429 | A | 2/1981 | Krol et al. | |
| 5,838,096 | A * | 11/1998 | Shinada et al. | 313/336 |
| 6,054,801 | A | 4/2000 | Hunt et al. | |
| 6,683,399 | B2 * | 1/2004 | Shiffler, Jr. | 313/311 |
| 6,875,462 | B2 * | 4/2005 | Shiffler, Jr. | 427/58 |
| 7,862,897 | B2 * | 1/2011 | Whitmarsh | 428/408 |
| 2005/0127814 | A1 | 6/2005 | Deguchi et al. | |

FOREIGN PATENT DOCUMENTS

| | | |
|---|---|---|
| DE | 836528 | 4/1952 |
| EP | 99908583 | 2/1999 |
| GB | 1517649 | 7/1978 |

OTHER PUBLICATIONS

Joseph Wang "Reticulated Vitreous Carbon—A New Versatile Electrode Material" Department of Chemistry, New Mexico State University, Las Cruoes, NM 88003, USA, Electrochim Acta vol. 26, No. 12, pp. 1721-1726, 1981.

* cited by examiner

*Primary Examiner* — Peter Macchiarolo
(74) *Attorney, Agent, or Firm* — Harness, Dickey & Pierce, P.L.C.

(57) ABSTRACT

According to example embodiments, a method for manufacturing a field emission cathode includes providing a liquid compound comprising a liquid phenolic resin and at least one of a metal salt and a metal oxide arranging a conductive cathode support in a vicinity of the liquid compound, and heating the liquid compound. Heating the liquid compound transforms the liquid compound into a solid compound foam.

11 Claims, 4 Drawing Sheets

CARBON BASED FIELD EMISSION CATHODE AND METHOD OF MANUFACTURING THE SAME

TECHNICAL FIELD

The present invention relates to a carbon material for a field emission cathode. The present invention also relates to a method for manufacturing of such a field emission cathode.

TECHNICAL BACKGROUND

The technology used in modern energy-saving lighting devices uses mercury as one of the active components. As mercury is harmful to the environment, extensive research is done to overcome the complicated technical difficulties associated with energy-saving, mercury-free lighting .

An approach used for solving this problem is by using a field emission device, such as field emission light source. Field emission is a phenomenon that occurs when an electric field proximate to the surface of an emission material narrows a width of a potential barrier existing at the surface of the emission material. This allows a quantum tunneling effect to occur, whereby electrons cross through the potential barrier and are emitted from the material.

In prior art devices, a cathode is arranged in an evacuated chamber. The chamber may have glass walls. The chamber may be coated on its inside with an electrically conductive layer. A light emitting layer may be deposited on top of the conductive layer. They together constitute an anode. When a potential difference is applied between the cathode and the anode, electrons are emitted from the cathode and accelerated towards the anode. As the electrons strike the light emitting layer, they cause the light emitting layer to emit photons. The process may be referred to as cathodoluminescence. Cathodoluminescence is different from photoluminescence. Photoluminescence is employed in conventional fluorescent lighting devices, such as conventional fluorescent tubes.

Cathodes used in field emission devices are accordingly known as field emission cathodes. Field emission cathodes are considered "cold" cathodes because they do not require the use of a heat source to operate. Among various materials known to be suitable for the construction of field emission cathodes, carbon based materials have proven to be capable of producing significant emission currents over a long lifetime in moderate vacuum environment.

European patent application 99908583, "Field emission cathode fabricated from porous carbon foam material", discloses a field emission cathode that includes an emission member formed of a porous carbon foam material, such as Reticulated Vitreous Carbon (RVC). The emissive member has an emissive surface defining a multiplicity of emissive edges. RVC is manufactured using a carbonized polymer resin.

The use of RVC as an emissive member has not been completely successful since the material has a period of instability. The period of instability has been referred to as the material's "training period.",The training period of RVC is believed to result from the desorption of contaminants initially present on the emission surface of the RVC cathode, and by the destruction of the sharpest emissive edges of the RVC material. The latter leads to a complicated fabrication process involving expensive and complex manufacturing steps. Furthermore, the operation voltage of such a field emission cathode, as disclosed above, has to be very high in order to obtain a sufficient output current because too few emission sites over the entire cathode surface.

An object of the present invention to address two crucial issues, the total emission current of the cathode at an appropriate voltage interval, and the uniform spatial and current distributions of the emission edges, in order to provide a novel and improved carbon material for a field emission cathode.

SUMMARY OF THE INVENTION

The above need is met by a carbon material for a field emission cathode and a corresponding method for manufacturing such a field emission cathode as defined in independent claims 1 and 8. The dependent claims define advantageous embodiments in accordance with the present invention.

According to a first aspect of the invention, a method for manufacturing a field emission cathode includes providing a liquid compound comprising a liquid phenolic resin and at least one of a metal, a metal salt, and a metal oxide. The method may further include arranging a conductive cathode support such that the conductive cathode support comes in a vicinity of the liquid compound, and heating the liquid compound, and forming a solid compound foam transformed from the liquid compound. The solid compound foam at least partly covers the conductive cathode support.

The method may be used to manufacture a field emission cathode using fewer manufacturing steps and at a fraction of the cost in comparison to the methods and materials used in the prior art.

Heating the liquid compound preferably takes place in an enclosed container, in which the conductive cathode support and the liquid compound have been arranged. The temperature for heating the liquid compound is below 100° C., such as at about 60° C.-90° C. As a result of the heating, the liquid compound will expand in volume, and subsequently form the solid compound foam that comes in firm contact with the conductive cathode support. The compound foam at least partly covers the conductive cathode support.

Work function describes the minimum energy (usually measured in electron volts) needed to remove an electron from the Fermi level to a point at an infinite distance away outside the surface. Furthermore, the expression training period defines the time during which the compound shows sign of instability. The metal salt can in one case be an alkaline metal salt. Similarly, the metal oxide can in one case be zinc oxide. The liquid compound can in a similar manner further comprise one or a plurality of acids compounds, surfactants, dispersion agents and organic or non-organic solvents.

The method includes performing a pyrolysis process on the solid compound foam at least partly covering said conductive cathode support, thereby forming a carbonized solid compound foam. The method includes performing a cutting action on the carbonized solid compound foam, thereby forming a plurality of sharp emission edges at the surface of the carbonized solid compound foam. The pyrolysis is preferably performed in a low vacuum environment at about 800° C.-1000° C. For the cutting process there are a large number of techniques available. In a preferred manner, a mechanical cutting process is utilized.

In a preferred embodiment of the present invention, the conductive cathode support is a rod, the container is a substantially cylindrical container, and the step of heating the liquid compound comprises the step of substantially aligning a longitudinal centre axis of the substantially cylindrical container with a horizontal plane axis. Furthermore, the substantially cylindrical container is preferably rotated around its substantially horizontal axis. These inventive manufacturing steps allow for the liquid compound to expand in volume inside the enclosed container in a radial and uniform manner. A solid compound foam is produced. The foam is in firm contact with and at least partly covers the conductive cathode support. The solid compound foam includes substantially uniform and structured characteristics.

To achieve advantageous coverage of the conductive cathode support, the axis of the conductive cathode support is preferably coincident with the substantially horizontal axis of the substantially cylindrical container.

As understood by the person skilled in the art, the conductive cathode support can be either a rod, as described above, or a substantially flat structure. In the case which involves the substantially flat structure, the container and the substantially flat structure can be one and the same. Flat field emission cathodes may be designed and constructed for utilization in large-area stadium-type displays.

The novel carbonized solid compound foam has a continuous cellular structure, having the advantages of two-dimensional interconnected sharp edges, such as knife edges, after cutting. The sharpness of the edges is determined by the thickness of the walls of the cellular structure.

A second aspect of the present invention relates to a cathode for emitting electrons when a potential difference is applied between the cathode and an anode in a field emission device application. The cathode includes a conductive cathode support and a carbonized solid compound foam at least partly covering the conductive cathode support. The carbonized solid compound foam is transformed from a liquid compound comprising a phenolic resin and at least one of a metal salt and a metal oxide. The metal salt and metal oxide can be one of an alkaline metal salt and zinc oxide respectively. The liquid compound can in a likewise manner further comprise one or a plurality of acids compounds, surfactants, dispersion agents and solvents.

As described above in relation to the first aspect of the present invention, this novel field emission cathode, with the novel compound, provides a plurality of advantages due to its low work function and the minimal or non-existing training period. Hence, this novel field emission cathode will provide the possibility to produce a field emission cathode at a lower cost with higher performance, as compared with methods and materials used in the prior art.

In a preferred embodiment of the second aspect of the present invention, the carbonized solid compound foam has a continuous cellular structure with a plurality of sharp emission edges arranged at the surface of said carbonized solid compound foam. This allows for an improved emission current. Experimental measurement using a field emission cathode, according to the present invention, in a field emission lamp, has measured an operational current of 3 mA at an operational voltage of 4 kV.

A third aspect of the present invention relates to an apparatus for manufacturing a cathode. The cathode may be used in a field emission device application. The apparatus includes a means for providing a liquid compound comprising a liquid phenolic resin and at least one of a metal salt, a metal oxide, a means for arranging a conductive cathode support such that said conductive cathode support comes in a vicinity of said liquid compound, and a means for heating said liquid compound in order to form a solid compound foam transformed from said liquid compound. The solid compound foam at least partly covers said conductive cathode support. This apparatus provides in a similar manner as describe above the possibility to manufacture a field emission cathode at a lower cost compared to materials and methods used in prior art.

A fourth aspect of the present invention relates to a field emission device application including a cathode, said cathode comprising a conductive cathode support and a carbonized solid compound foam at least partly covering said conductive cathode support, wherein said carbonized solid compound foam is transformed from a liquid compound comprising a phenolic resin and at least one of a metal salt, a metal oxide, an anode, means for arranging said anode and said cathode in an evacuated chamber, and control electronics.

In a preferred embodiment of this fourth aspect of the present invention, the field emission device application can be one of a lighting source application and an X-ray source application. Such a field emission device application can be either an enclosed unit or an arrangement comprising, but not limited to, the mentioned components.

Further features and advantages of the present invention will become apparent when studying the appended claims and the following description. Those skilled in the art will appreciate that different features of the present invention can be combined in other ways to create embodiments other than those described in the following.

BRIEF DESCRIPTION OF THE DRAWINGS

The present invention will now be described in more detail with reference to the accompanying drawings, in which:

FIG. 4*a* shows a carbonized solid compound foam with a plurality of sharp emission edges located at the surface of the carbonized solid compound foam.

DETAILED DESCRIPTION OF THE PREFERRED EMBODIMENT

Figure 1A:
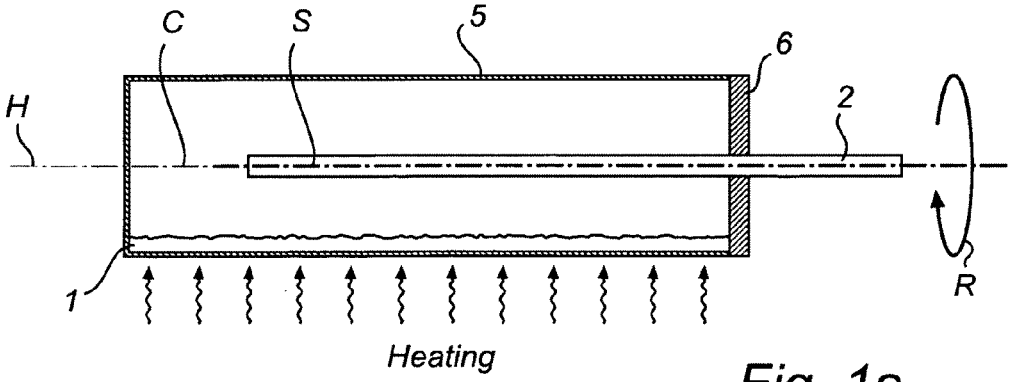
FIG. 1*a* illustrates a schematic side cross-section of a conductive cathode support aligned with a substantially horizontal axis of a substantially cylindrical container.

FIG. 1*a* illustrates a schematic side cross section of an apparatus for some of the initial steps in performing a method according to the present invention. A conductive cathode support 2 has been positioned inside of a substantially cylindrical container 5. The center axis S of the conductive cathode support 2 has been substantially aligned with a center axis C of the substantially cylindrical container 5. Furthermore, the two center axes C and S have been aligned with a horizontal plane H. A lid 6 is enclosing the substantially cylindrical container 5 wherein a liquid compound 1 is heated. The direction of the heating is not limited to only the bottom of the substantially cylindrical container 5, but can of course take place from an arbitrary direction. The substantially cylindrical container 5, is rotatable R around its center axis C.

Figure 1B:
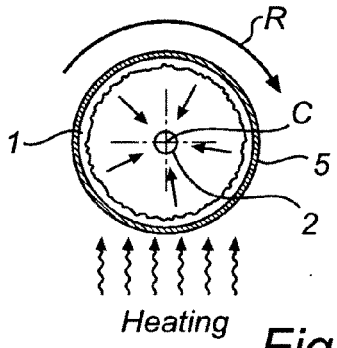
FIG. 1*b* illustrates a schematic end cross-section of a conductive cathode support aligned with a substantially horizontal axis of a substantially cylindrical container as illustrated in FIG. 2*a*.

FIG. 1*b* illustrates a schematic and cross-section of a conductive cathode support 2, aligned with a substantially horizontal axis C of a substantially cylindrical container 5 as illustrated in FIG. 1*a*.

Figure 2:
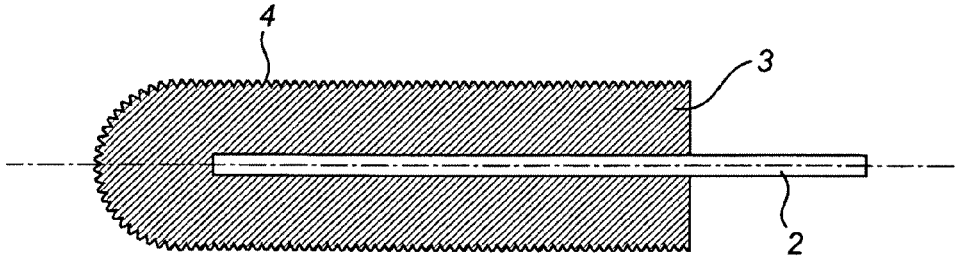
FIG. 2 illustrates a cross-section of a field emission cathode according to the present invention.

FIG. 2 illustrates a cross-section of a field emission cathode according to the present invention. A conductive cathode support 2 is covered by a carbonized solid compound foam 3, having a continuous cellular structure.

The field emission cathode further comprises a plurality of sharp emission edges 4 arranged at the surface of the carbonized solid compound foam 3. These emission edges 4 are arranged at uniform emission sites.

Figure 3:
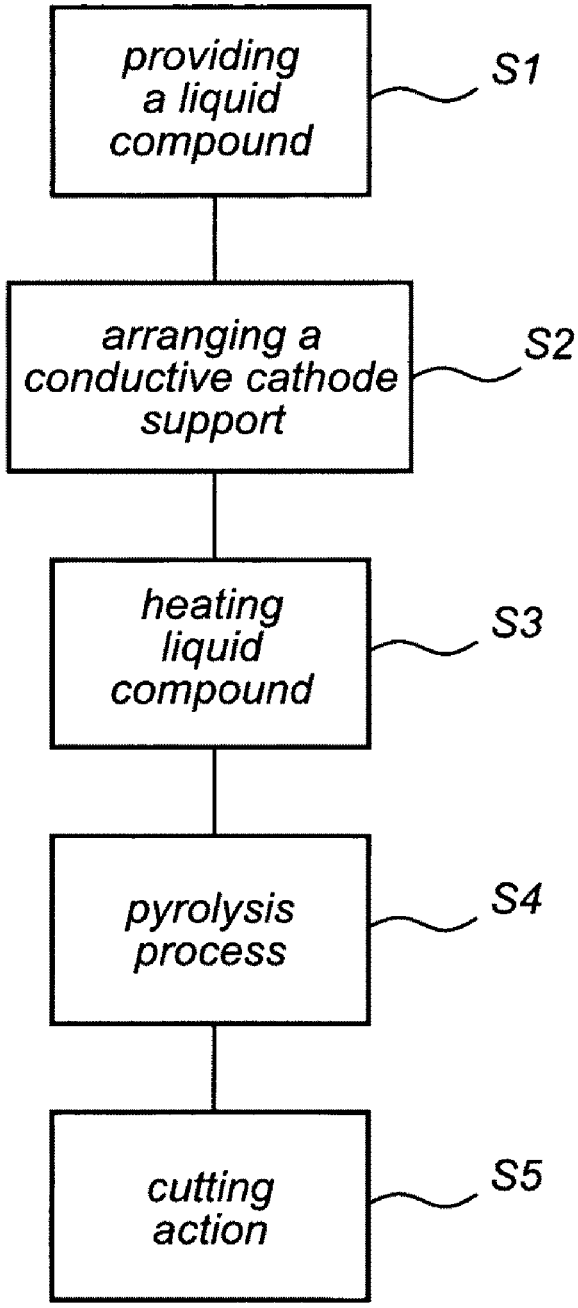
FIG. 3 illustrates the steps of manufacturing a field emission cathode according to the present invention.

FIG. 3 illustrates the processing steps of manufacturing a field emission cathode according to the present invention. Referring to FIG. 3, the process steps includes providing S1 a liquid compound 1, arranging S2 a conductive cathode support 2, heating S3 the liquid compound 1, performing a pyrolysis process S4 on the solid compound foam, and performing a cutting action S5 on the carbonized solid compound foam 3. These process steps are carried out in the order of description in the present embodiment.

In the step of providing S1 a liquid compound 1, a compound is prepared. This compound comprises a liquid phenolic resin and at least one of an alkaline metal, an alkaline metal salt, and an alkaline metal oxide, acid compounds, surfactants, dispersion agents and solvents.

These ingredients are mixed as thoroughly as possible for them to dissolve properly.

The step of providing S1 the liquid compound 1 is followed by the step of arranging S2 the conductive cathode support 2 such that the conductive cathode support 2 comes in a vicinity of the liquid compound 1. In the case where the conductive cathode support 2 is configured as a rod, this is preferably done by arranging the conductive cathode support 2 inside of the substantially cylindrical container 5 as described in FIGS. 1*a* and 1*b*.

The step of arranging S2 the conductive cathode support 2 is followed by the step of heating S3 the liquid compound 1. The heating is done at a temperature below 100° C., such as at about 60° C. to 90° C. As a result of the heating, the liquid compound 1 will radial expand in volume, creating the solid compound foam 3 that comes in firm contact with the conductive cathode support 2 as can be seen in FIG. 2. Preferably, the conductive cathode support 2 is at least partly covered by the solid compound foam 3. At the same time as the heating takes place, the substantially cylindrical container 5 is rotated R around its center axis C. During the heating and the rotating, the liquid compound expand in volume inside of the enclosed container 5 in a radial and uniform manner, producing the solid compound foam 3 having substantially uniform and structured characteristics. Prior art methods of covering conductive cathode support comprised a "dipping" process that produced a solid compound foam that had non-uniform and non-structured characteristics.

Subsequently, a pyrolysis processing step S4 is performed on the solid compound foam 3 that at least partly covers the conductive cathode support 2. The pyrolysis step S4 is performed in an low vacuum environment at about 800° C. to 1000° C.

The pyrolysis step S4 is followed by a mechanical cutting step S5. The field emission cathode is arranged in a mechanical cutting machine, wherein the carbonized solid compound foam gets a plurality of sharp emission edges 4 at the surface of the carbonized solid compound foam.

Figure 4A:
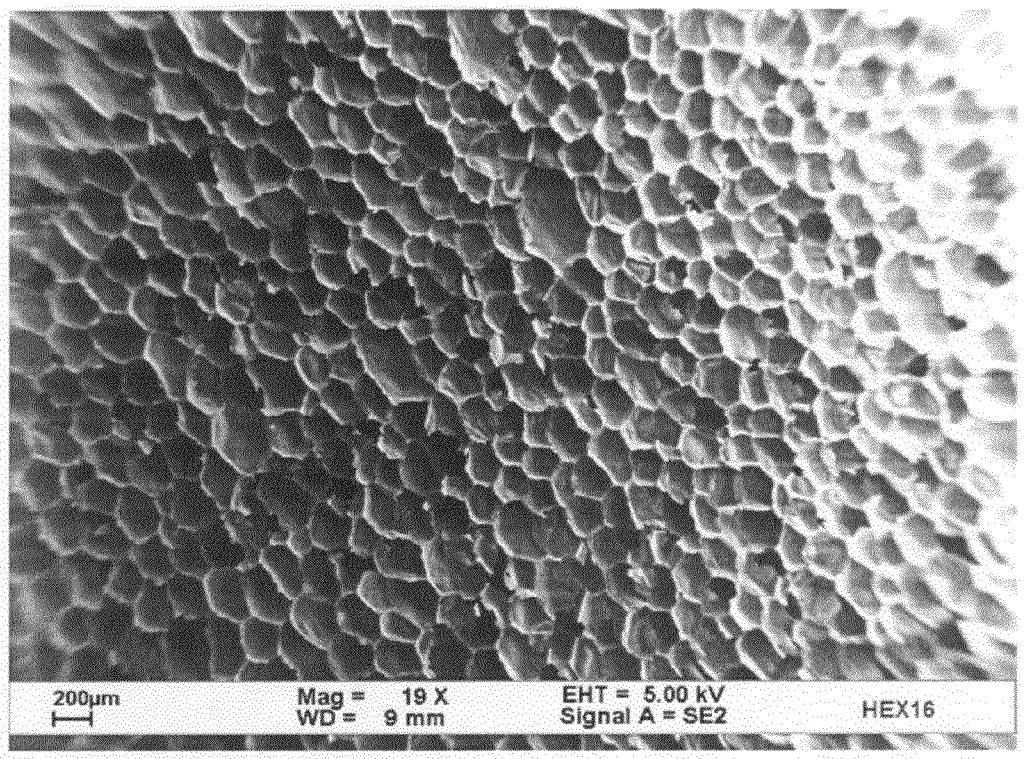
FIG. 4*a* shows a scanning electron microscope microphotography of an incline view of a field emission cathode according to the present invention.
Figure 4B:
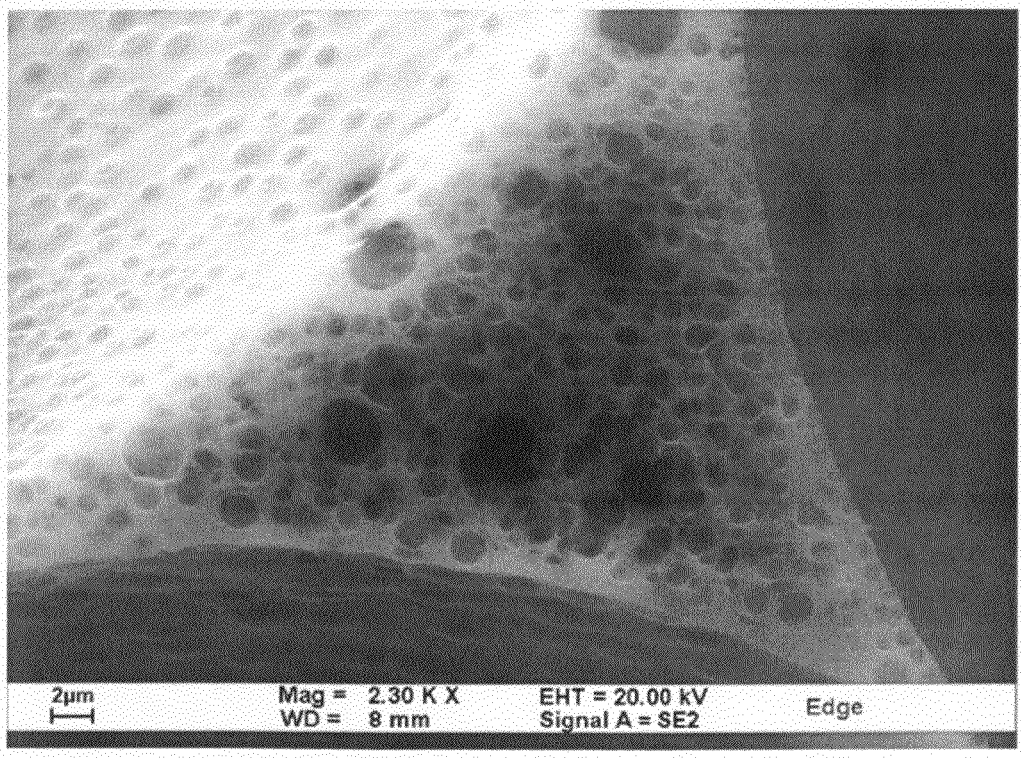
FIG. 4*b* is a close-up view of the scanning electron microscope microphotography view in FIG. 4*a*, illustrating an emission site with the triple junction of the emission edges.
Figure 4C:
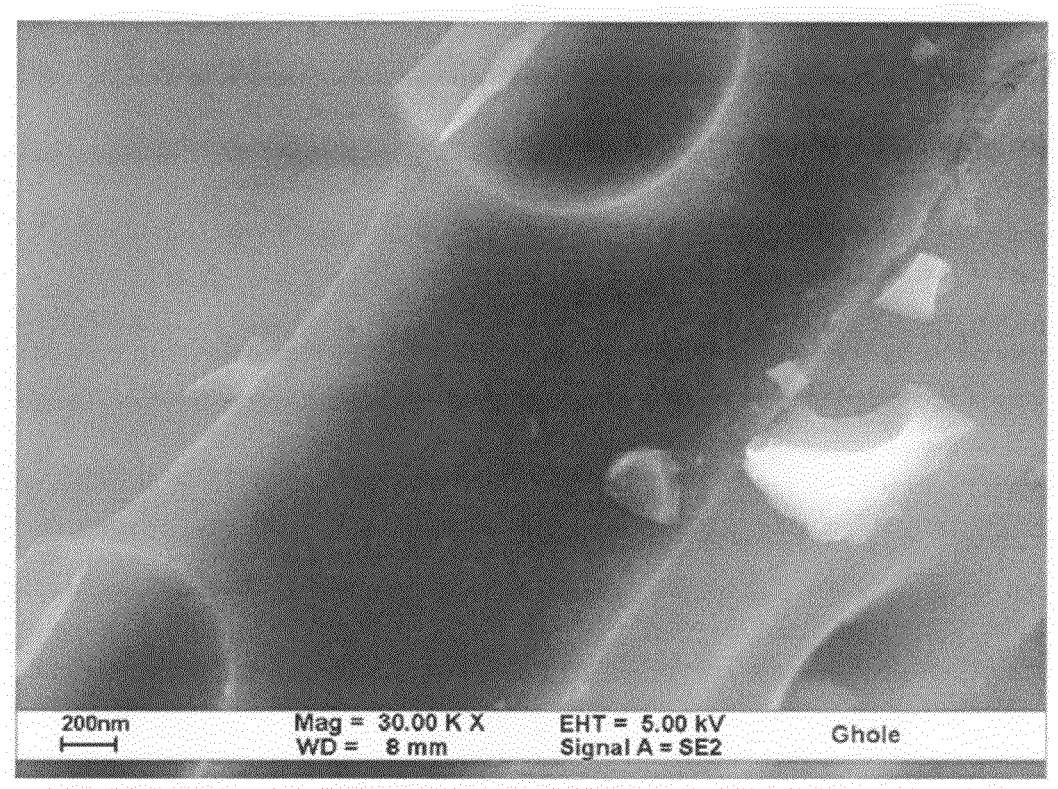
FIG. 4*c* is a further close-up view of the scanning electron microscope microphotography view showed in FIG. 4*a*, illustrating sharp emission edges.

FIGS. 4*a* to 4*c* illustrates scanning electron microscope microphotographs of the surface of a carbonized field emission cathode according to the present invention .

FIG. 4*a* illustrates a continuous cellular structure of two-dimensional interconnected sharp edges, such as knife edges, that can be seen at the surface of the carbonized compound foam material. The compound foam material is transferred from a liquid compound comprising a phenolic resin and at least one of an alkaline metal salt, an alkaline metal oxide.

FIG. 4*b* illustrates a close-up view of the image shown in FIG. 4*a*, wherein an emission site (triple junction) can be seen. This emission site has been formed through the mechanical cutting action as described above. FIG. 4*c* illustrates a further close-up view of the image shown in FIG. 4*a*, wherein a detailed view of a sharp field emission edge can be seen. The sharpness of the edges is determined by the thickness of the walls of the cellular structure.

Figure 5:
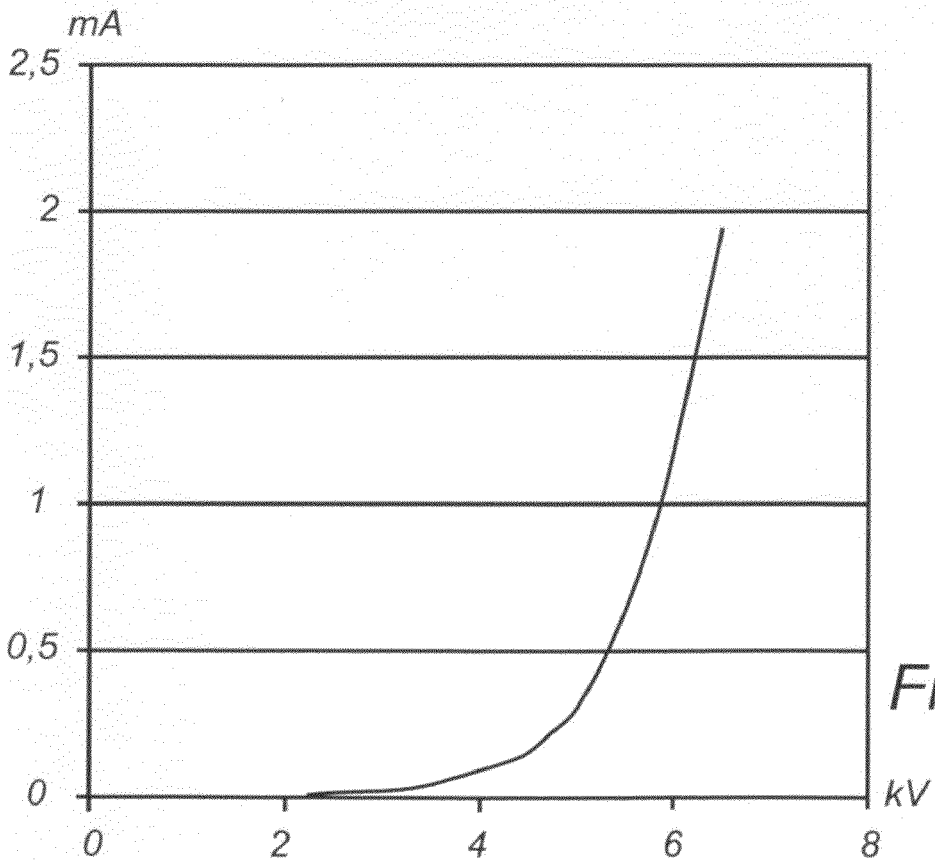
FIG. 5 is a graph of the typical emission current/applied voltage (a so called I/V curve) of an experimental test performed on a field emission cathode according to the present invention.

FIG. 5 is a graph illustrating an experimental test performed on a field emission cathode according to the present invention. The graph shows the typical voltage that has been applied between an anode and a field emission cathode in a field emission application device. Prior art field emission cathodes, such as an RVC cathode as described above, produced an unstable emission current upon the initial application of voltage, which was characterized by a series of spikes in the emission current. With a field emission cathode according to the present invention, instability in emission current is almost minimal or non-existing. Furthermore, as can be seen in FIG. 5, the operational current that is needed to reach an applicable emission current, is much lower that in prior art field emission cathodes.

Although the present invention and its advantages have been described in detail, is should be understood that various changes, substitutions and alternations can be made herein without departing from the spirit and scope of the invention as defined by the appended claims. For example the invention is not limited to a field emission cathode wherein the conductive cathode support is a rod, but as will be understood by the person skilled in the art, the conductive cathode support can be of any suitable shape, such as a plate, suitable for use in a field emission device application.

The invention claimed is:

1. A method, for manufacturing a field emission cathode, comprising:

providing a liquid compound comprising a liquid phenolic resin and at least one of a metal salt and a metal oxide;

arranging a conductive cathode support in a vicinity of said liquid compound arranging the conductive cathode support and the liquid compound in an enclosed container;

heating said liquid compound, thereby forming a solid compound foam, transformed from said liquid compound, wherein the liquid compound as a result of the heating will expand in volume inside of the enclosed container to form the solid compound foam that will be provided in firm contact with the conductive cathode support and at least partly covering the conductive cathode support.

2. A method according to claim 1, wherein the method further comprises performing a pyrolysis process on said solid compound foam at least partly covering said conductive cathode support, thereby forming a carbonized solid compound foam.

3. A method according to claim 2, further comprising: performing a cutting action on said carbonized solid compound foam, thereby forming a carbonized solid compound foam with a plurality of sharp emission edges.

4. A method according to claim 3, wherein said carbonized solid compound foam has a continuous cellular structure.

5. A method according to claim 1, wherein said conductive cathode support is a rod, wherein said container is a substantially cylindrical container, and wherein the heating said liquid compound comprises substantially aligning a longitudinal centre axis of said substantially cylindrical container with a horizontal plane axis.

6. A method according to claim 5, wherein the heating said liquid compound in said substantially cylindrical container comprises rotating said substantially cylindrical container around its substantially horizontal axis.

7. A cathode, for emitting electrons when a potential difference is applied between the cathode and an anode in a field emission device application, wherein the cathode is manufactured according to the method of claim 1.

8. A field emission device application comprising:

a cathode manufactured according to the method of claim 1;

an anode;

a means for arranging said anode and said cathode in an evacuated chamber; and control electronics.

9. A field emission device application according to claim 8, wherein said field emission device application is one of a lighting source application and an X-ray application.

10. The method according to claim 1, wherein the metal salt includes an alkaline metal salt, and the metal oxide includes an alkaline metal oxide.

11. An apparatus for manufacturing a cathode, for use in a field emission device application, comprising:

means for providing a liquid compound comprising a liquid phenolic resin and at least one of a metal, a metal salt, and a metal oxide;

means for arranging a conductive cathode support together with the liquid compound in the enclosed container, thereby arranging the conductive cathode support in the vicinity of said liquid compound, wherein the liquid compound as a result of the heating will expand in volume inside of the enclosed container to form the solid compound foam that will be provided in firm contact with the conductive cathode support and at least partly covering the conductive cathode support.

* * * * *